US008006860B2

(12) United States Patent
Klein

(10) Patent No.: US 8,006,860 B2
(45) Date of Patent: Aug. 30, 2011

(54) PORTABLE GUM CONTAINER

(76) Inventor: Marianne Christine Klein, Toronto (CA)

( * ) Notice: Subject to any disclaimer, the term of this patent is extended or adjusted under 35 U.S.C. 154(b) by 607 days.

(21) Appl. No.: 11/956,782

(22) Filed: Dec. 14, 2007

(65) Prior Publication Data

US 2009/0151115 A1 Jun. 18, 2009

(51) Int. Cl.
*B65D 1/24* (2006.01)
*B65D 43/14* (2006.01)

(52) U.S. Cl. ..... 220/503; 220/507; 220/524; 220/818; 206/800

(58) Field of Classification Search ..... 206/528, 206/531, 216, 233, 494, 38, 527; 220/503, 220/507, 524, 54, 909, 818, 826, 827, 833
See application file for complete search history.

(56) References Cited

U.S. PATENT DOCUMENTS

| | | | | |
|---|---|---|---|---|
| 603,949 | A | 5/1898 | Harding | |
| 969,329 | A | 9/1910 | Blake | |
| 1,915,522 | A | 6/1933 | Eriksen | |
| 2,007,042 | A | 7/1935 | Duckett | |
| 2,484,892 | A | 10/1949 | Keston | |
| 2,757,859 | A | 8/1956 | Holland | 232/43.2 |
| 3,845,858 | A | 11/1974 | Jenkins | 206/233 |
| 4,022,319 | A | 5/1977 | Jenkins | 206/233 |
| 4,078,662 | A | 3/1978 | Volland | 206/564 |
| 4,483,440 | A | 11/1984 | Ware | 206/233 |
| 5,458,277 | A | 10/1995 | Wyzykowski | 224/202 |
| D455,880 | S | 4/2002 | Nicoud et al. | D34/1 |
| 6,520,329 | B1 | 2/2003 | Fuchs et al. | 206/449 |
| 6,830,152 | B2 | 12/2004 | Smith | 206/527 |
| 2004/0173475 | A1 | 9/2004 | Shimko | 206/233 |
| 2006/0051457 | A1 | 3/2006 | Bougoulas et al. | 426/5 |

FOREIGN PATENT DOCUMENTS

| | | |
|---|---|---|
| DE | 29919654 | 4/2000 |
| EP | 0082118 | 3/1986 |
| EP | 0481680 | 6/1994 |
| JP | 08-058904 | 3/1996 |
| JP | 09-202370 | 8/1997 |
| JP | 09-255035 | 9/1997 |
| WO | 2005/100173 | 10/2005 |

*Primary Examiner* — J. Gregory Pickett
*Assistant Examiner* — Kaushikkumar Desai
(74) *Attorney, Agent, or Firm* — Vidas, Arrett & Steinkraus P.A.

(57) ABSTRACT

There is disclosed a portable gum container, comprising a body. The body has a chewing gum holder, a sheet material dispenser, and a waste receptacle. The chewing gum holder is for holding chewing gum. The sheet material dispenser is for dispensing sheet material sized and shaped for wrapping about a piece of spent chewing gum. The waste receptacle is sized and shaped to contain the wrapped spent piece of chewing gum. Also disclosed is a portable gum container, comprising a body having a chewing gum holder, a waste receptacle and at least one piece of sheet material associated with the body for wrapping about a piece of spent chewing gum.

42 Claims, 8 Drawing Sheets

PORTABLE GUM CONTAINER

FIELD OF THE INVENTION

The present invention relates generally to containers for chewing gum. More particularly, the present invention relates to portable gum containers which can fit in a pocket, purse, hand bag, or the like.

BACKGROUND OF THE INVENTION

Chewing gum is a popular and widely enjoyed confectionery. It is typically provided in neat, clean packages, which allow the gum to be conveniently carried in pockets, purses, hand bags, or the like. Furthermore, individual pieces of chewing gum are typically individually packaged or wrapped so the gum can be placed in the mouth without needing to touch it.

However, once the chewing gum has been spent by chewing, it needs to be disposed of. Unfortunately, because spent chewing gum is sticky, wet, and generally messy, there are at least two problems with its disposal.

First, it leaves a sticky residue on the hand used to remove the spent chewing gum out of the mouth to place it somewhere else. Furthermore, because the spent chewing gum is sticky, wet and messy, it can not be placed in a pocket, purse or the like to be discarded at a later time such as when a proper garbage receptacle is located.

Accordingly, for most gum chewers, spent chewing gum poses an inconvenience. For example, in restaurants gum chewers must remove the chewing gum from their mouths to eat and drink their food. In the past, restaurants had ashtrays on the tables, and gum chewers could discard the spent chewing gum in the ashtray. Although, this solved the disposal problem, it did not solve the problems of the sticky residue on the hand, nor the problem of removing the sticky gum from the ashtray. Nowadays, because of the smoking bans in restaurants, ashtrays are no longer present on the tables, and gum chewers face the problem of what to do with the spent chewing gum.

In situations where there is no nearby garbage receptacle in which to discard the spent chewing gum, the gum chewer typically has no choice but to discard the spent chewing gum anyway, when no one is looking. For example people have been known to stick spent chewing gum under restaurant tables and chairs, or on the ground as they are walking. As can be appreciated, such methods of discarding the spent chewing gum are unsanitary, and impact the environment since it is very difficult to remove the spent chewing gum from such surfaces.

U.S. Pat. No. 969,329 which issued to Blake on Sep. 6, 1910, and German Utility Model number 299 19 654 which issued to Kientopf on Apr. 20, 2000 disclose similar attempts to overcome the above problems with spent chewing gum. Both Blake and Kientopf disclose a gum box associated with a holder for the spent gum. However, in both of these devices, the spent chewing gum sticks to the walls of the container which is unsanitary and makes it difficult to dispose of the gum when a suitable garbage receptacle is finally located. Moreover, the user must handle the spent chewing gum when transferring it from the containers to the garbage receptacle, which, as mentioned above, is sticky, wet and generally messy.

U.S. patent application publication number 2006/0051457 of Bougoulas et al. discloses a much later attempt to overcome the above problems with spent chewing gum. Bougoulas et al. disclose a chewing gum package with gum disposal accommodations. The gum disposal accommodation is described as a disposal sheets which are associated with the chewing gum package for wrapping spent chewing gum prior to disposal. However, this reference fails to teach a waste receptacle associated with the chewing gum package. Accordingly, users of the Bougoulas device still experience the nuisance of dealing with the wrapped spent gum until they locate a garbage receptacle.

Accordingly, there is a need for improvement in this field. What is desired, therefore, is a device which addresses at least some of the problems with spent chewing gum discussed above.

SUMMARY OF THE INVENTION

In accordance with one aspect of the present invention, there is disclosed a simple, compact and easy to use, portable gum container having a body which may be used to hold a standard blister pack, tube pack, stick pack, or individual pieces of chewing gum. The body also includes a sheet material dispenser, and a waste receptacle. The sheet material dispenser is for dispensing sheet material which can be used to wrap about a piece of spent chewing gum, without needing to touch it directly. The wrapped, spent chewing gum may then be placed in the self-contained waste receptacle for temporary storage until a proper garbage receptacle, or the like, is located, at which time the container's waste receptacle may be emptied into the garbage receptacle. The entire container is sized and shaped to be portable, by fitting in a pocket, purse, hand bag, or the like. In this manner it can be kept conveniently on hand for use when and as needed.

Therefore, one aspect of the present invention is to provide a portable gum container, comprising a body having:

a chewing gum holder;

a sheet material dispenser for dispensing sheet material sized and shaped for wrapping about a piece of spent chewing gum; and a waste receptacle sized and shaped to contain said wrapped spent piece of chewing gum.

Another aspect of the present invention is to provide portable gum container, comprising a body having:

a chewing gum holder;

a waste receptacle sized and shaped to contain a wrapped spent piece of chewing gum; and at least one piece of sheet material associated with said body; said at least one piece of sheet material being sized and shaped for wrapping about a piece of spent chewing gum.

BRIEF DESCRIPTION OF THE DRAWINGS

Reference will now be made to the preferred embodiments of the present invention with reference, by way of example only, to the following drawings in which.

DETAILED DESCRIPTION OF THE PREFERRED EMBODIMENTS

The present invention is described in more detail with reference to exemplary embodiments thereof as shown in the appended drawings. While the present invention is described below including preferred embodiments, it should be understood that the present invention is not limited thereto. Furthermore, it should be noted that the figures are not intended to depict particular scales or proportions. However, like elements are given like reference numbers in the figures.

Figure 1:
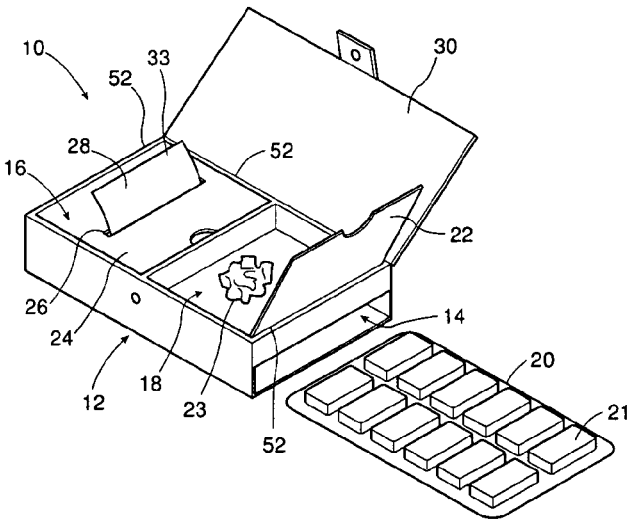
FIG. 1 is a perspective view of a portable gum container according to a first embodiment of the present invention in a partially open position, with a blister pack of gum about to be inserted.

FIG. 1 is a perspective view of a portable gum container 10 according to an embodiment of the present invention, which is usable with a blister pack 20 of chewing gum 21. The blister pack 20 will be known to those skilled in the art and therefore is not described in any more detail herein. The gum container 10 of the present invention comprises a body 12 having a sheet material dispenser 16, a waste receptacle 18, and a chewing gum holder 14. A first cover 22 is attached to the body by a living hinge 52 to cover the waste receptacle 18 (as shown in FIG. 1 in the open position, and FIG. 2 in the closed position) and contain material placed therein. Similarly, a second cover 24 is attached to the body by a living hinge 52 (as shown in FIG. 1 in the closed position, and FIG. 4 in the open position) to cover the sheet material dispenser 16, and to form a closeable receptacle for storing the sheet material 28. The body 12 is preferably provided with a lid 30 (as shown in FIG. 1 in an open position, and FIG. 3 in the closed position) which may be used to cover and protect the sheet material dispenser 16 and the waste receptacle 18 when the gum container 10 is not being used.

The portable gum container 10 may be made from any suitable material, including, paper, plastic, metal, wood, leather, fabric, or combinations thereof. Furthermore, the body 12 of the portable gum container may contain advertising information or may be decorated in any manner as is well known in the art.

The chewing gum holder 14 is preferably sized and shaped to accommodate a standard pack of chewing gum, such as for example a blister pack 20 which is shown in FIG. 1 ready to be inserted into the gum holder 14. However, the chewing gum holder 14 may be sized and shaped to accommodate various shapes and sizes of blister packs, tube packs, stick packs, and even individual pieces of chewing gum, as explained in more detail below, what is desired is a way to accommodate conventional gum packaging easily and conveniently within the body of the present invention, for storage purposes.

The sheet material dispenser 16 is intended to contain and dispense at least one piece of sheet material 28, which the user may use to wrap a piece of spent chewing gum, without needing to contact the spent piece of chewing gum directly with his or her hands. For example, the user may obtain a piece of sheet material 28 from the sheet material dispenser 16, and then pinch the piece of sheet material 28 into a slight V-shape. The user may then spit the spent chewing gum from his or her mouth into the center of the V-shaped piece of sheet material 28, and pinch the piece of sheet material 28 about the spent piece of chewing gum to form a sandwich in which the piece of spent chewing gum is fully contained in the piece of sheet material 28. The user may then place the wrapped spent piece of chewing gum 23 into the waste receptacle 18, for subsequent disposal. As can now be appreciated, the user is able to discard the spent piece of chewing gum in the conveniently located waste receptacle 18, without leaving a sticky residue on his or her hands. Furthermore, the user may easily discard the wrapped spent piece of chewing gum 23 from the waste receptacle 18 into a garbage receptacle when one is located at a later time. Since the spent piece of chewing gum is now wrapped by the piece of sheet material 28 it will not stick to the walls of the waste receptacle 18, or the garbage receptacle. To facilitate easy removal of the wrapped spent chewing gum, the waste receptacle 18 is preferably coated with a non-stick coating or the like.

The waste receptacle 18 is sized and shaped to contain several wrapped spent pieces of chewing gum 23. This size is preferred to permit the user to chew through several pieces of gum without needing to find a garbage receptacle, or otherwise toss the spent gum on the ground. FIG. 1 shows a wrapped spent piece of chewing gum 23 in the waste receptacle 18. The waste receptacle 18 may have a first cover 22 attached thereto which is shown in FIG. 1 in an open position, and in FIG. 2 in the closed position, to hide and contain the contents of the waste receptacle 18. As noted above, the waste receptacle 18 may be coated with a nonstick coating, or made with a nonstick material to allow for easy disposal of the contents of the waste receptacle, by for example preventing spent pieces of chewing gum from sticking to the walls thereof.

The piece of sheet material 28 may be made of any flexible sheet material of suitable size and shape which will permit the user to wrap the spent piece of chewing gum without the spent piece of chewing gum contacting his or her hands, such as for example, paper, wax or coated paper, foil, film, plastic, fiber, or combinations thereof. Furthermore, the piece of sheet material 28 may be in the form of recycled paper, allowing the user to refill the sheet material dispenser 16 by for example cutting or tearing pieces of newspaper, newsprint, or even writing paper to size and placing the pieces into the sheet material dispenser 16. What is important is that the sheet material dispenser 16 is configured to contain a piece of sheet material which the user may use to wrap a piece of spent chewing gum without contacting the spent piece of chewing gum, and the associated sticky residue and saliva, with his or her hands.

Figure 2:
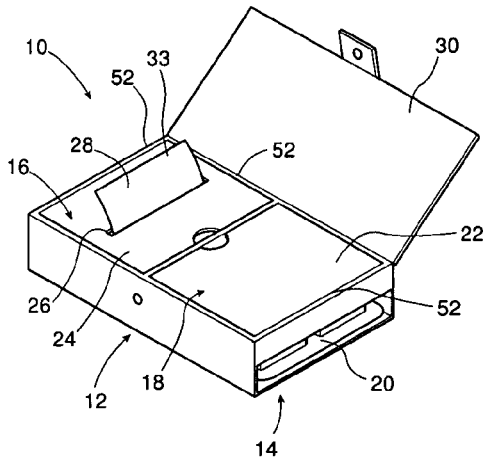
FIG. 2 is a perspective view of the portable gum container of FIG. 1 in a partially closed position, with the blister pack of chewing gum fully inserted.
Figure 3:
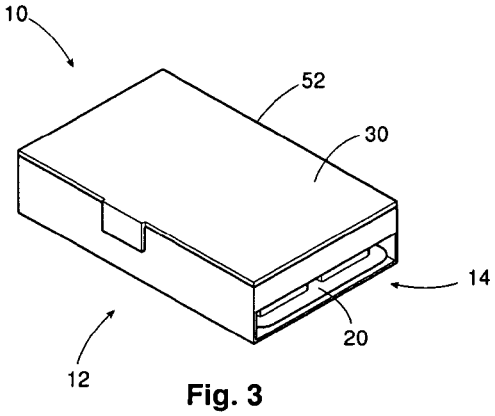
FIG. 3 is a perspective view of the portable gum container of FIG. 2 with the container in a fully closed, pocket-ready, position.
Figure 4:
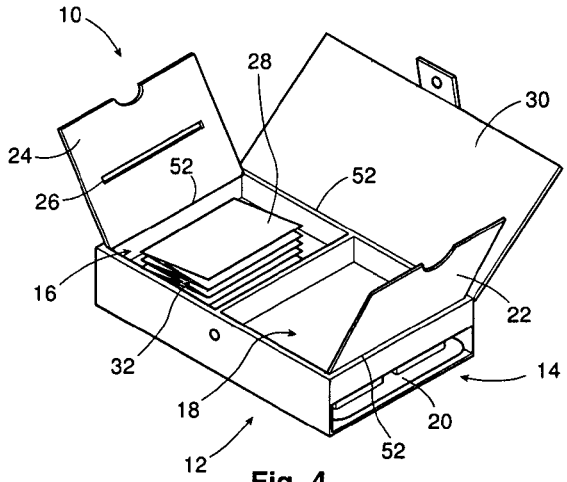
FIG. 4 is a perspective view of the portable gum container of FIG. 3 in a fully open position, having sheet material, in the form of a stack of interleaved pieces of sheet material.
Figure 5:
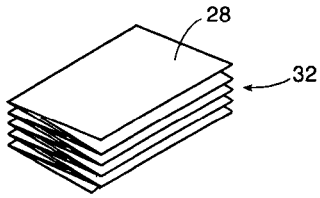
FIG. 5 is a perspective view of the stack of interleaved pieces of sheet material of FIG. 4.
Figure 6:
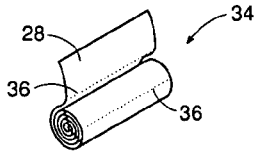
FIG. 6 is a perspective view of an alternate embodiment of the sheet material of FIG. 5 in the form of a continuous roll of sheet material.

In both FIGS. 1 and 2, the sheet material dispenser 16 has a second cover 24 attached to it in a closed position. A slot 26 is provided in the second cover 24 through which the piece of sheet material 28 is drawn from the sheet material dispenser 16. As shown in FIG. 4, the piece of sheet material 28 may be provided in the sheet material dispenser 16 in the form of a stack 32 of individual interleaved pieces of sheet material 28, wherein when the user grips an exposed piece of sheet material 28 and draws the exposed piece of sheet material from the sheet material dispenser 16 through the slot 26, the next piece of sheet material in the stack will be exposed for gripping and drawing by the user. Thus the act of drawing one piece of sheet material 28 through the slot 26 results in a next piece of sheet material 28 to be drawn into position in the slot 26 for subsequent use, and so on. As an example, a stack 32 of interleaved sheet material 28 is shown in FIG. 5.

Figure 7:
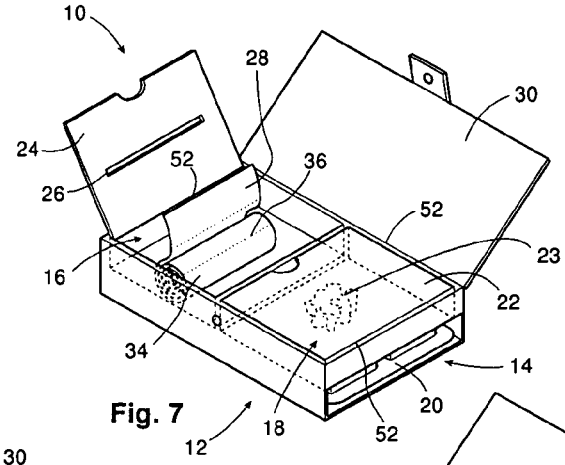
FIG. 7 is a perspective view of a portable gum container according to another embodiment of the present invention, having the continuous roll of sheet material of FIG. 6.

However, according to another embodiment of the present invention, the piece of sheet material 28 may be provided in the sheet material dispenser 16 in the form of a continuous roll 34 as shown, for example, in FIG. 7. It is contemplated that the continuous roll 34 of sheet material may be provided with regularly recurring lines of weakness, such as lines of perforations 36, across the width of the continuous roll 34 to permit pieces of sheet material 28 to be severed from the continuous roll 34 as they are pulled through the slot 26, while leaving an end 33 of the continuous roll 34 exposed in the slot 26.

Figure 8:
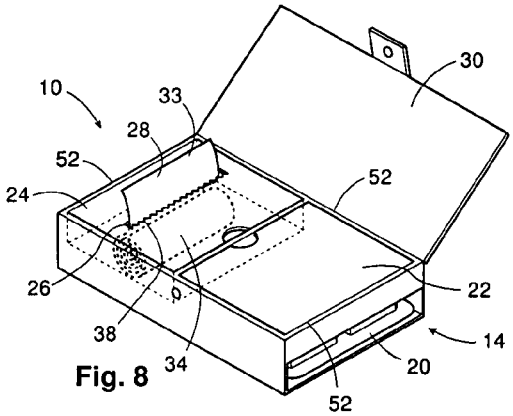
FIG. 8 is a perspective view of a portable gum container according to another embodiment of the present invention, having a cutting means, in the form of a serrated edge.

Other embodiments of the present invention do not require the continuous roll 34 to be provided with the lines of weakness. For example, in the embodiment of the gum container 10 shown in FIG. 8, the slot 26 is provided with a cutting means adapted to permit pieces of sheet material 28 to be severed from the continuous roll 34. The cutting means is shown by way of example as a serrated edge 38 positioned within and along one side of the slot 26. Accordingly, the user can preferably sever off pieces of sheet material 28 from the continuous roll 34 by pulling and pressing the exposed end 33 of the continuous roll 34 across the serrated edge 38.

Figure 9:
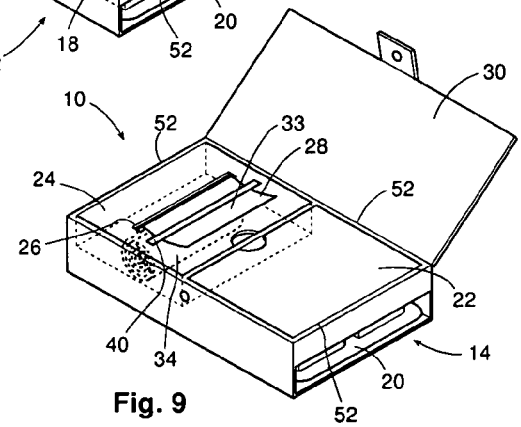
FIG. 9 is a perspective view of a portable gum container according to another embodiment of the present invention, having a cutting means, in the form of a cutting blade.

FIG. 9 shows another embodiment of the gum container 10 of the present invention, which contains a cutting means in the form of a cutting blade 40 for severing individual pieces of sheet material 28 from the continuous roll 34. According to this embodiment the cutting blade is positioned on the second cover 24 adjacent to the slot 26 and the exposed end of the continuous roll 34 is drawn from the continuous roll 34 through the slot 26 and under the cutting blade 40. The user may sever off pieces of sheet material 28 from the continuous roll 34 by pulling and pressing the exposed end 33 of the continuous roll 34 across the cutting blade 40.

While embodiments of the present invention described above in relation to FIGS. 1, 2, 4, 7, 8, 9 include a sheet material dispenser 16 having second cover 24 with a slot 26 through which the user may pull out a piece of sheet material 28, other embodiments are contemplated which do not require the slot 26.

Figure 10:
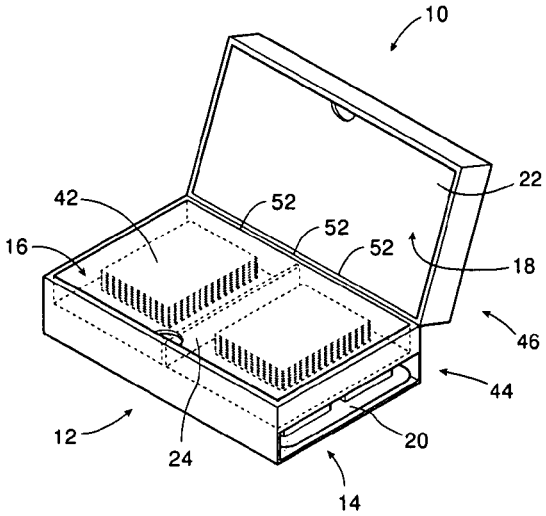
FIG. 10 is a perspective view of a portable gum container according to another embodiment of the present invention, in a partially open position, stacks of sheet material, and a blister pack fully inserted.

For example, FIG. 10 shows an embodiment of the gum container 10 of the present invention, in which two stacks 42 of non-interleaved pieces of sheet material 28 are contained in the sheet material dispenser 16. According to this embodiment a plurality of pieces of sheet material 28 are piled one on top of the other in one or more stacks within the sheet material dispenser 16. The user simply opens the second cover 24, and removes the now exposed top most piece of sheet material 28 in the stack 42.

It will be appreciated that the portable gum container 10 is provided with a sheet material dispenser 16 which is refillable with at least one piece of sheet material 28. Preferably, the portable gum container 10 is provided with a sheet material dispenser 16 which is refillable with a stack 32 of interleaved pieces of sheet material 28, a continuous roll 34, or a stack 42 of non-interleaved pieces of sheet material 28, as appropriate.

The portable gum container 10 may be arranged in many shapes, sizes, and configurations, only some of which are described herein by way of example. For example, in the above, the portable gum container 10 has been described as a body containing a chewing gum holder 14, a sheet material dispenser 16, a waste receptacle 18, and an optional lid 30 to cover the sheet material dispense 16 and the waste receptacle 18.

However, as shown in FIG. 10 it is also contemplated that the portable gum container 10 may be configured with a body 12 comprising two sections 44, 46 attached together, such that the first section 44 contains the chewing gum holder 14, and one of the sheet material dispenser 16 and the waste receptacle 18, and the second section 46 contains the other of the sheet material dispenser 16 and the waste receptacle 18. While the two sections 44, 46 are preferably attached together via a living hinge 52, other modes of attachment will be readily apparent to persons skilled in the art.

Figure 11:
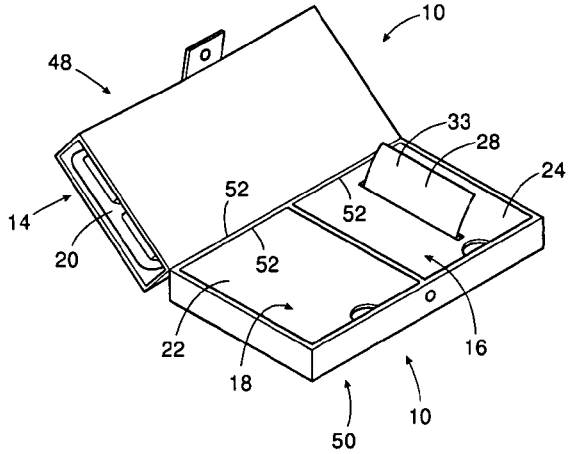
FIG. 11 is a perspective view of a portable gum container according to another embodiment of the present invention, in a partially open position, having sheet material, and a blister pack fully inserted.
Figure 12:
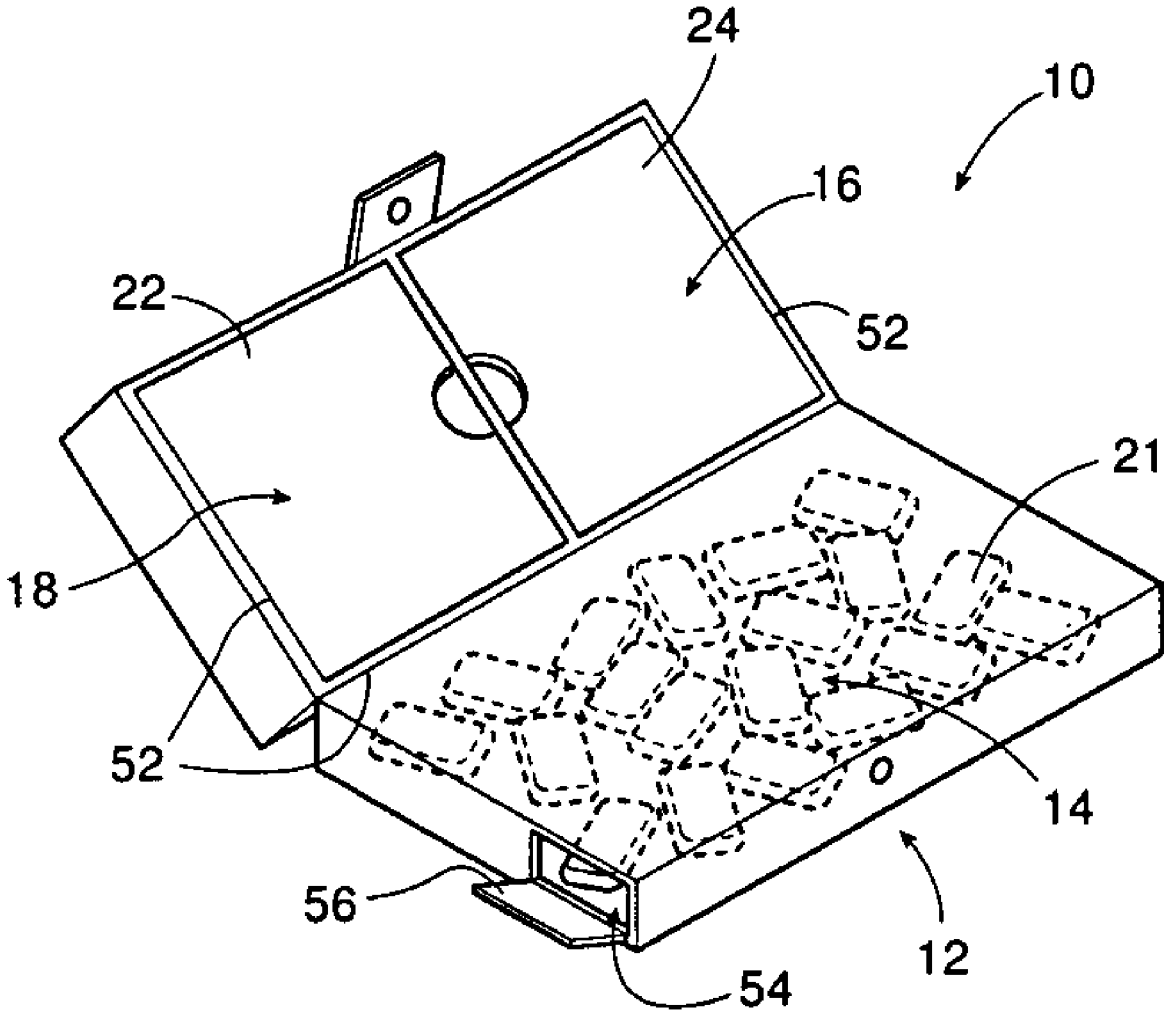
FIG. 12 is a perspective view of a portable gum container according to another embodiment of the present invention, in a partially open position, containing individual pieces of chewing gum.

Similarly, as shown in FIGS. 11 and 12, the portable gum container 10 according to another aspect of the present invention is configured with a body comprising two sections 48, 50 attached together, such that the first section 48 contains the chewing gum holder 14, and the second section 50 contains the sheet material dispenser 16 and the waste receptacle 18. According to this embodiment, the sheet material dispenser 16 and the waste receptacle 18 are positioned adjacent to one another. As above, the two sections 48, 50 are preferably attached together via a living hinge 52.

In FIG. 12, the chewing gum holder 14 is sized and shaped to accommodate individual pieces of chewing gum 21. The user may retrieve the pieces of chewing gum 21 through a closeable opening 54 in the chewing gum holder 14. When not in use the closeable opening 54 is closed by a door 56 to prevent the individual pieces of chewing gum 21 from falling out of the chewing gum holder 14.

Figure 13:
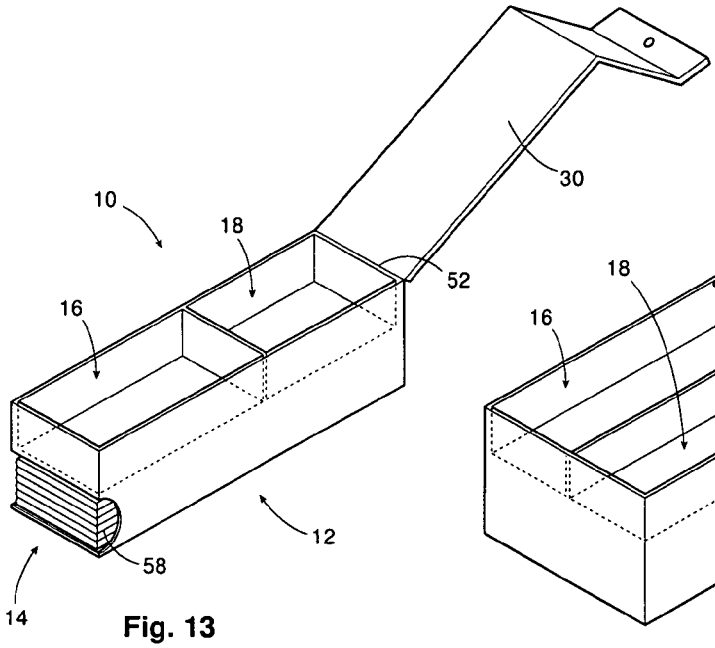
FIG. 13 is a perspective view of a portable gum container according to another embodiment of the present invention, in a fully open position, with individual pieces of stick gum fully inserted.

FIG. 13 shows another embodiment of the portable gum container 10 of the present invention which is useable with stick gum 58. According to this embodiment, the body 12 has a chewing gum holder 14 which is sized and shaped to accommodate individually wrapped sticks of gum 58, or a standard pack of stick gum. The gum can be oriented horizontally in the gum holder 14 (i.e. one flat slab of stick gum on top of another), as shown in FIG. 13, or vertically (i.e. one flat slab of stick gum beside the next). As shown, the sheet material dispenser 16 and the waste receptacle 18 are arranged adjacent to one another along the outside of the chewing gum holder 14. A lid 30 is attached to the body, preferably by a living hinge 52, to cover the sheet material dispenser 16, the waste receptacle 18, and the chewing gum holder 14, when the gum container 10 is not in use.

The portable gum container shown in FIG. 13 is preferably used with individually wrapped pieces of stick gum 58, so that the gum wrapper can be removed from the stick gum and placed in the dispenser 16 for subsequent reuse as a piece of sheet material 28 in wrapping the spent piece of chewing gum when the user is finished chewing the gum. The wrapped spent piece of chewing gum is then placed in the waste receptacle 18, as described above.

Figure 14:
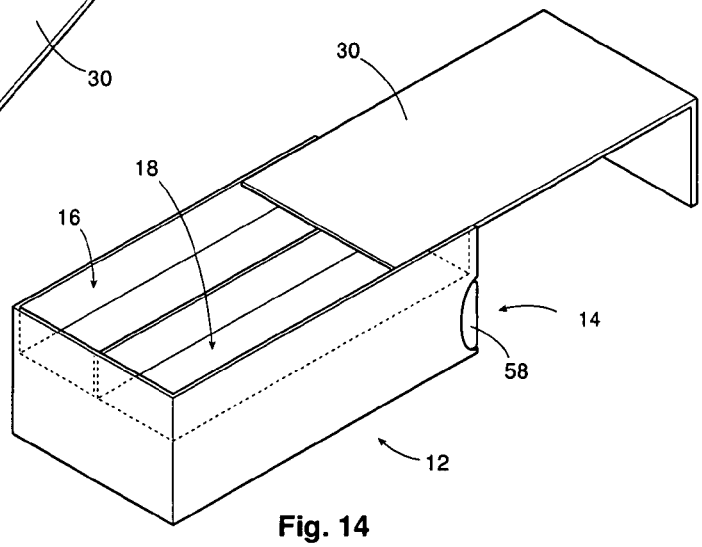
FIG. 14 is a perspective view of a portable gum container according to another embodiment of the present invention, in a fully open position, with a stick pack fully inserted.

FIG. 14 shows a variation of the embodiment of the portable gum container 10 in FIG. 13. According to this embodiment, the body 12 has a chewing gum holder which is sized and shaped to accommodate individually wrapped sticks of gum 58, or one or more standard packs of stick gum. The gum can be oriented horizontally in the gum holder 14 (i.e. one flat slab of stick gum on top of another) or vertically (i.e. one flat slab of stick gum beside the next), as shown in FIG. 14. As shown, the sheet material dispenser 16 and the waste receptacle 18 are arranged adjacent to one another along the outside of the chewing gum holder 14. The lid 30 is slidingly attached to the body 12 to cover the sheet material dispenser 16, the waste receptacle 18, and the chewing gum holder 14, when the portable gum container 10 is not in use.

Figure 15:
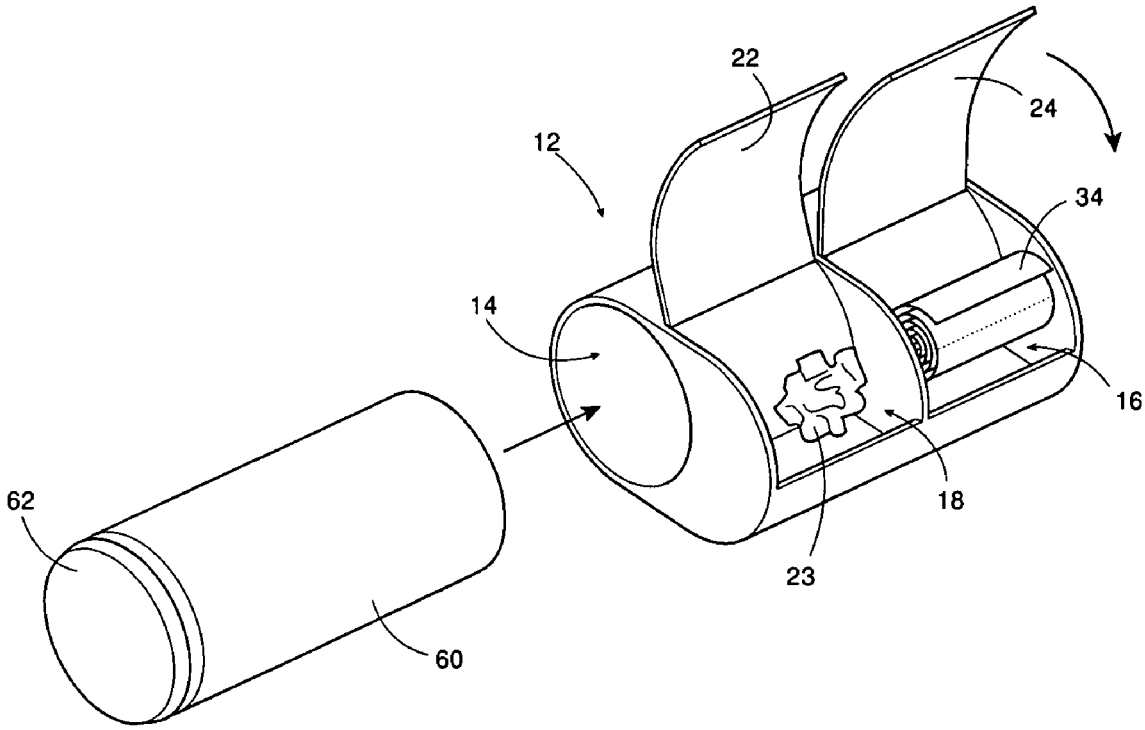
FIG. 15 is a perspective view of a portable gum container according to another embodiment of the present invention, in a fully open position, with a tube pack about to be inserted.

FIG. 15 shows another embodiment of the portable gum container 10 of the present invention which is useable with a tube pack 60 of chewing gum 21. According to this embodiment, the body 12 has a chewing gum holder 14 which is sized and shaped to accommodate a standard tube pack 60 of chewing gum. As shown, the tube pack is insertable into the chewing gum holder 14 such that the capped end 62 is exposed outside the body 12 and may be opened while the tube pack 60 is secured in the sleeve of the chewing gum holder 14. The sheet material dispenser 16 and the waste receptacle 18 are arranged adjacent to one another along the outside of the chewing gum holder 14. A first and second cover 22, 24 are attached to the body 12 to cover the waste receptacle 18 and the sheet material dispenser 16, respectively. Also shown is a wrapped spent piece of chewing gum 23 in the waste receptacle 18, and a continuous roll 34 of sheet material 28 in the sheet material dispenser 16.

Figure 16:
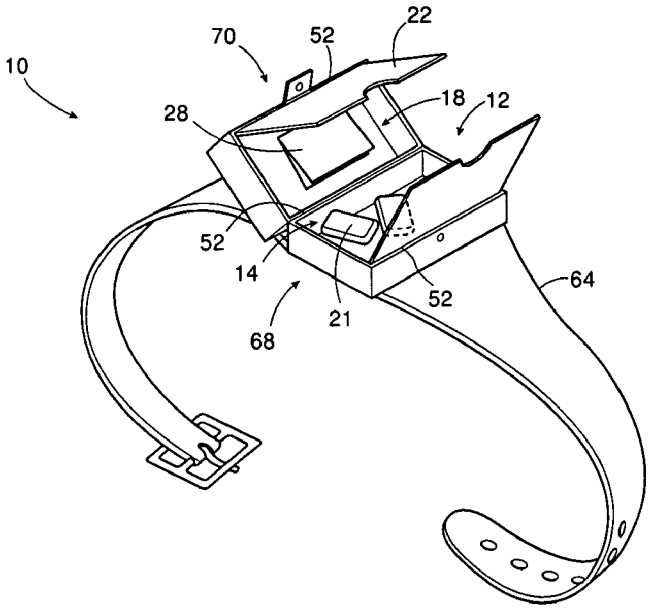
FIG. 16 is a perspective view of a portable gum container according to another embodiment of the present invention, in a fully open position, having individual pieces of gum in a gum dispenser, and sheet material in a waste receptacle.
Figure 17:
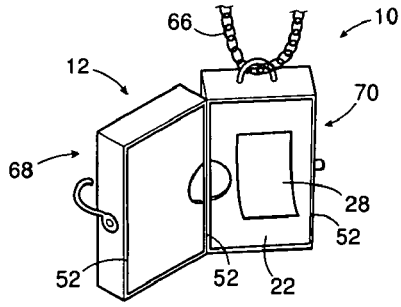
FIG. 17 is a perspective view of a portable gum container according to another embodiment of the present invention, in a partially open position, with a piece of sheet material.

FIGS. 16 and 17 show another embodiment of the portable gum container 10 of the present invention, in which the body 12 includes a securement member to allow securement of the portable gum container 10 to a part of the user's body (i.e. neck, arm, leg, wrist, ankle, waist, hip, etc.), or a wearable article (i.e. clothing, fashion accessory, backpack, purse, briefcase, etc.). In FIG. 16, the securement member is a wrist band 64 to permit securement of the portable gum container to a user's wrist in the same fashion as a typical wrist watch. In FIG. 17, the securement member is a necklace 66 to permit securement of the portable gum container to a user's neck. According to another embodiment of the present invention, the securement member may be provided as a chain, bracelet, strip of flexible string-like material, or the like to permit securement of the portable gum container to a user's neck, wrist, hip, ankle, backpack, clothing, fashion accessory, belt, belt loop, or the like. According to yet other embodiments, the securement member may be provided as a snap, clip, clasp, or hook and loop fastener, various configurations and types of which are well known in the clothing and fashion accessory industry and are therefore not described in any more detail herein.

Furthermore, in the embodiment shown in FIGS. 16 and 17, the portable gum container 10 comprises a body 12 with two sections 68, 70 attached together by a living hinge 52. The first section 68 has a chewing gum holder 14, and the second section 70 has a waste receptacle 18. The waste receptacle 18 is sized and shaped to contain at least one wrapped spent piece of chewing gum 23. Associated with the body 12 is at least one piece of sheet material 28. The piece of sheet material 28 is sized and shaped for wrapping about a piece of spent chewing gum. In FIG. 16 the piece of sheet material 28 is shown as being associated with the waste receptacle 18. In use, the user may obtain a piece of chewing gum 21 from the chewing gum holder 14. When the user is ready to dispose of the spent piece of chewing gum he or she may obtain a piece of sheet material 28 from the waste receptacle 18, wrap the spent piece of chewing gum, and place the wrapped spent piece of chewing gum 23 into the waste receptacle 18. In FIG. 17, the piece of sheet material 28 is shown as being associated with the body 12 by being releasably attached to the first cover 22 of the waste receptacle 18.

While reference has been made to various preferred embodiments of the invention other variations, implementations, modifications, alterations and embodiments are comprehended by the broad scope of the appended claims. Some of these have been discussed in detail in this specification and others will be apparent to those skilled in the art. Those of ordinary skill in the art having access to the teachings herein will recognize these additional variations, implementations, modifications, alterations and embodiments, all of which are within the scope of the present invention and intended to be covered by the appended claims, without limitation.

I claim:

1. A portable gum container, comprising a body having a top, a bottom and a plurality of sides extending therebetween, an upper portion and a lower portion, the body comprising:

a chewing gum holder forming the lower portion with an opening in one of the sides between the top and the bottom;

a sheet material dispenser for dispensing sheet material sized and shaped for wrapping about a piece of spent chewing gum, the sheet material dispenser having an opening therein; and a waste receptacle sized and shaped to contain said wrapped spent piece of chewing gum, the waste receptacle having an opening therein;

wherein the body is configured such that the sheet material dispenser and the waste receptacle form the upper portion and are positioned adjacent to one another in a side-by-side relationship, on and over the chewing gum holder, and the opening in the sheet material dispenser and the opening in the waste receptacle face the top and are accessible from the top.

2. A portable gum container according to claim 1, wherein the waste receptacle comprises interior walls which have non-stick surfaces.

3. A portable gum container according to claim 1, wherein said chewing gum holder is sized and shaped to accommodate a pack of chewing gum.

4. A portable gum container according to claim 3, wherein said pack of chewing gum is either a blister pack, a tube pack, or a stick pack.

5. A portable gum container according to claim 4, wherein said stick pack contains gum in a wrapper, said wrapper being sheet material, and said dispenser is adapted to receive and hold said wrapper ready for subsequent use in wrapping said spent piece of chewing chewing gum.

6. The portable gum container according to claim 3, wherein the chewing gum holder is a sleeve into which said pack of chewing gum is insertable.

7. A portable gum container according to claim 1, wherein said chewing gum holder is sized and shaped to accommodate individual pieces of chewing gum.

8. A portable gum container according to claim 7, wherein said chewing gum holder has a closeable opening to allow said individual pieces of chewing gum to be dispensed from or retained in the chewing gum holder.

9. The portable gum container according to claim 1, wherein the waste receptacle has a first cover disposed above the waste receptacle and above a portion of the chewing gum holder.

10. The portable gum container according to claim 9, wherein the first cover is attached to the waste receptacle via a living hinge.

11. The portable gum container according to claim 1, wherein said sheet material dispenser further comprises a stack of non-interleaved pieces of said sheet material.

12. The portable gum container according to claim 1, wherein said sheet material dispenser has a second cover.

13. The portable gum container according to claim 12, wherein said second cover has a slot adapted to permit said sheet material to be drawn therethrough.

14. The portable gum container according to claim 13, wherein said sheet sheet material dispenser further comprises a stack of interleaved pieces of said sheet material, wherein when a user grips an exposed piece of sheet material and draws said exposed piece of sheet material from said sheet material dispenser through said slot, the next piece of sheet material in said stack will be exposed for gripping and drawing by the user.

15. The portable gum container according to claim 13, wherein said sheet material dispenser further comprises a continuous roll of said sheet material.

16. The portable gum container according to claim 15, wherein the roll of sheet material contains severing means permitting individual sheets to be severed from the roll.

17. The portable container according to claim 16, wherein the severing means is a line of weakness in the sheet material.

18. The portable container according to claim 17, wherein the line of weakness is a line of perforations in the sheet material.

19. The portable gum container according to claim 15, wherein the sheet material dispenser comprises a cutting means adapted to permit individual sheets of said sheet material to be severed from said continuous roll of sheet material.

20. The portable gum container according to claim 19, wherein the cutting means is positioned within the slot.

21. The portable container according to claim 19, wherein the cutting means is positioned on the second cover adjacent the slot.

22. The portable gum container according to claim 12, wherein the second cover is attached to said sheet material dispenser via a living hinge.

23. The portable gum container according to claim 1, wherein said sheet material dispenser is refillable with one of (i) a stack of interleaved pieces of said sheet material, (ii) a stack of non-interleaved pieces of said sheet material, or (iii) a continuous roll of said sheet material.

24. The portable gum container according to claim 1, wherein said sheet material is paper, foil, film, plastic, fiber, or combinations thereof.

25. The portable gum container according to claim 1, further comprising a lid attached to the body, said lid being adapted to cover the waste receptacle and the sheet material dispenser, wherein the lid is disposed above the waste receptacle and the sheet material dispenser and extends over and covers the openings of the waste receptacle and the sheet material dispenser but does not extend over and cover the opening of the chewing gum holder.

26. The portable gum container according to claim 25, wherein the lid is attached to the body via a living hinge.

27. The portable gum container according to claim 1, wherein the body comprises two sections attached together, wherein the first section contains the chewing gum holder, and one of the dispenser and the receptacle, and the second section contains the other of the sheet material dispenser and the waste receptacle.

28. The portable gum container according to claim 27, wherein the two sections are attached together via a living hinge.

29. The portable container according to claim 1, wherein the body comprises two sections attached together, wherein the first section contains the chewing gum holder, and wherein the second section contains the sheet material dispenser and the waste receptacle.

30. The portable gum container according to claim 29, wherein the two sections are attached together via a living hinge.

31. The portable gum container according to claim 30, wherein the sheet material dispenser and the waste receptacle are adjacent to one another.

32. The portable gum container according to claim 1 sized to fit in a purse or a pocket.

33. The portable gum container according to claim 1, wherein said body is made of paper, plastic, metal, wood, leather, fabric, or combinations thereof.

34. The portable gum container according to claim 1, wherein the body further comprises a securement member to allow securement of the container to a part of the user's body, or wearable article.

35. The portable gum container according to claim 34, wherein the securement member is a wrist band, chain, necklace, bracelet, strip of flexible string-like material, clip, clasp, or hook and loop fastener.

36. The portable gum container of claim 1 wherein the chewing gum holder contains individual pieces of gum.

37. The portable gum container of claim 1 wherein the chewing gum holder contains a blister pack or stick pack of chewing gum.

38. A portable gum container, comprising a body having a top and a bottom and a plurality of sides extending therebetween:

a chewing gum holder located at the bottom of the container, the chewing gum holder having a side-facing opening in one of the sides between the top and the bottom;

a waste receptacle sized and shaped to contain a wrapped spent piece of chewing gum; and a sheet material dispenser with least one piece of sheet material disposed therein, said at least one piece of sheet material being sized and shaped for wrapping about a piece of spent chewing gum, the waste receptacle and the sheet material dispenser located at the top of the container and disposed in a side-by-side arrangement, each of the waste receptacle and the sheet material dispenser located on and above the chewing gum holder, wherein each of the waste receptacle and the sheet material dispenser are covered by a closable cover forming the top of the container, the waste receptacle and the sheet material dispenser each having an interior which is accessible from the top.

39. The portable gum container of claim 38 wherein the waste receptacle and the sheet material dispenser are openable independently from one another.

40. The portable gum container according to claim 38 sized to fit in a purse or a pocket.

41. The portable gum container of claim 35 wherein the chewing gum holder contains individual pieces of gum.

42. The portable gum container of claim 35 wherein the chewing gum holder contains a blister pack or stick pack of chewing gum.

* * * * *